United States Patent [19]

Cataudella

[11] Patent Number: 4,800,649

[45] Date of Patent: Jan. 31, 1989

[54] DISPOSABLE SHAVER

[76] Inventor: John Cataudella, 6147 Gage, Apt. 3B, Rosemont, Ill. 60018

[21] Appl. No.: 145,288

[22] Filed: Mar. 21, 1988

Related U.S. Application Data

[60] Continuation of Ser. No. 924,420, Oct. 29, 1986, abandoned, which is a division of Ser. No. 810,210, Dec. 18, 1985, Pat. No. 4,716,652, which is a continuation-in-part of Ser. No. 539,092, Oct. 5, 1983, Pat. No. 4,562,643.

[51] Int. Cl.[4] ..... B26B 19/44

[52] U.S. Cl. ..... 30/41; 30/86; 222/386

[58] Field of Search ..... 30/41, 86; 222/80, 82, 222/87, 192, 323, 386, 465 R

[56] References Cited

U.S. PATENT DOCUMENTS

| | | | |
|---|---|---|---|
| 269,928 | 9/1904 | Ziegler | 222/386 X |
| 1,335,840 | 4/1970 | Waylor | 30/41 |
| 1,542,363 | 6/1925 | Lieberthal | 222/80 |
| 1,950,769 | 3/1934 | Baar | 30/41 |
| 2,230,758 | 7/1941 | Fromch | 222/386 X |
| 2,790,234 | 4/1957 | Goldstein | 30/41 |
| 2,795,356 | 6/1957 | Tschumy | 222/95 |
| 3,412,465 | 11/1968 | Anderson | 30/41 |
| 4,228,587 | 10/1980 | Bennett | 30/41 |

FOREIGN PATENT DOCUMENTS

| | | | |
|---|---|---|---|
| 162696 | 5/1955 | Australia | 222/103 |
| 2426549 | 12/1979 | France | 30/41 |
| 490808 | 8/1937 | United Kingdom | 30/41 |

*Primary Examiner*—Douglas D. Watts
*Attorney, Agent, or Firm*—Robert M. Ward

[57] ABSTRACT

A disposable shaver having a unified handle and shaving lubricant container including in one embodiment a slideable manually operated plunger for expelling the shaving lubricant therefrom, and including in a preferred embodiment, such container having manually collapsable, corrugated walls for dispensing the shaving lubricant therefrom.

5 Claims, 2 Drawing Sheets

DISPOSABLE SHAVER

This application is a continuation application of Ser. No. 924,420, filed Oct. 29, 1986 (now abandoned), which was a divisional application of Ser. No. 810,210, filed Dec. 18, 1985 (now issued as U.S. Pat. No. 4,716,652), which was a continuation-in-part of application Ser. No. 539,092, filed Oct. 5, 1983 (now issued as U.S. Pat. No. 4,562,643).

BACKGROUND OF THE INVENTION

The present invention relates to safety razors for shaving and more particularly to a portable and disposable shaver including a combination handle and lubricant container.

The prior art has proposed several different razors which have included the convenience of a container to the handle portion thereof for carrying the shaving lubricant. However, such prior art razors have had numerous disadvantages. One such disadvantage has been the relatively complex nature of the mechanism required to dispense the shaving lubricant. Another disadvantage has been the inordinate cost of producing these lubricating dispensing mechanisms.

Another disadvantage which has attended the prior art has been that such razors have been too costly to produce to render such razors disposable, thereby materially reducing their convenience.

The disposable razor of the present invention is intended to materially alleviate these and other disadvantages associated with prior art devices.

SUMMARY OF THE INVENTION

The present invention is directed to a disposable shaver which includes in combination a shaving head, and a unified handle and shaving lubricant container. The shaving head includes a blade holding means for holding at least one blade at a selected angle with respect to a shaving surface.

The present invention also is directed to one of several preferred embodiments of a unified handle and shaving lubricant container, each of which is connected to a shaving head. In one preferred embodiment the unified handle and shaving lubricant container includes a longitudinally disposed slot which is sealed by a membrane, and engaged by a slideable slot rupturing lubricant pushing means. In use, the user may push upon and move an associated manual engagement button, which ruptures the slot membrane, and slides the lubricant pushing means to compress and expel a selected quantity of shaving lubricant from an opening in the unified handle and lubricant container.

In another preferred embodiment, the unified handle and shaving lubricant container includes a substantially rigid handle means, with an elongated shaving lubricant container attached thereto comprising flexible, corrugated walls, such that shaving lubricant may be expelled from the container by manual collapsing of such walls.

These and other embodiments of the present invention may be better understood upon review of the following brief description of the drawing, detailed description of preferred embodiments, appended claims and the drawing.

DETAILED DESCRIPTION OF PREFERRED EMBODIMENTS

Figure 1:
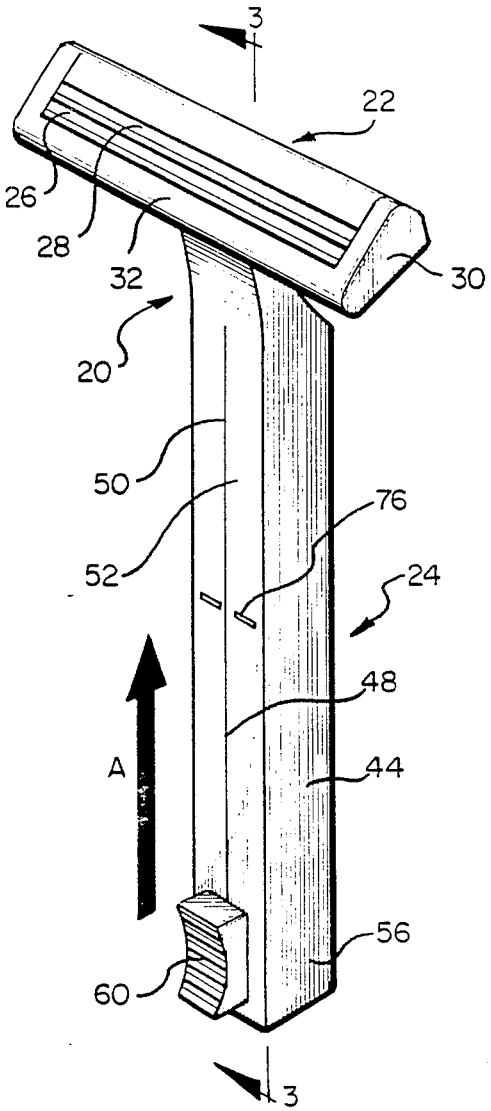
FIG. 1 is a perspective view of the disposable shaver of the present invention showing the shaving head, and the connected unified handle and shaving lubricant container, with rupturable membrane disposed within the slot, and further showing the manual engagement button to be moved in the direction of arrow A.

The disposable shaver of the present invention comprises in combination a shaving head with a unified handle and shaving lubricant container.

The shaving head includes at least one razor blade which is operatively disposed within a blade holding means. The blade holding means has a shaving surface thereon for contact with the surface to be shaved, such as for example the beard of the user. The razor blade is disposed and maintained at a selected angle with respect to the shaving surface of the blade holding means for disposition in a proper configuration for satisfactory comfort and effectiveness in shaving.

In one preferred embodiment of the disposable shaver of the present invention, the unified handle and shaving lubricant container includes an elongated and substantially hollow shaving lubricant container which has a bore located therein for containing the shaving lubricant. The container is connected at one end thereof to the shaving head to dispose the shaving head in proper shaving array when the unified handle and shaving lubricant container is manually held.

The shaving lubricant container is defined by walls thereof and has a closable opening at one end thereof. The shaving lubricant container walls have a slot therein which is closed by a relatively thin and rupturable membrane. The slot is disposed within and extends longitudinally along a wall of the shaving lubricant container.

The unified handle and shaving lubricant container further includes a membrane rupturing means which is slidably disposed within the slot and initially disposed in a first position at one end of the slot. The membrane rupturing means includes and attached at one end thereof a shaving lubricant pushing means, which is disposed within and substantially matches in cross-sectional shape the bore of the unified handle and shaving lubricant container. The membrane rupturing means includes a manual engagement button disposed at an opposite end thereof. In operation, the user pushes upon and moves the manual engagement button longitudinally with respect to the unified handle and shaving lubricant container to rupture the membrane, to transport the shaving lubricant pushing means longitudinally within the bore, and to force the shaving lubricant to expel from the opposite end of the unified handle and shaving lubricant container through the closable opening therein.

In preferred embodiment of the disposable shaver of the present invention, the unified handle and shaving lubricant container further comprises a preferably unitarily formed and attached plug means for closing the closable opening which is provided for preventing shaving lubricant to be expelled therefrom.

The disposable shaver of the present invention, in other preferred embodiments, may include a pair of cylindrically shaped sleeve portions having respective openings therein for expelling shaving lubricant therefrom. The respective openings are disposed in a common transverse plane, and such sleeve portions are disposed in rotational relationship. In operation, upon rotation of one of the sleeve portions with respect to the other, the openings are aligned to permit expelling of the shaving lubricant therefrom. In this embodiment of the disposable shaver of the present invention, the openings in the sleeve portions are disposed near the end of the unified handle and shaving lubricant container, such end being opposite from the end thereof having the membrane rupturing means when disposed in the first position.

In preferred embodiments of the disposable shaver of the present invention, the walls of the unified handle and shaving lubricant container may preferably have at least one exterior surface which is substantially planar. Such substantially planar surface of the walls carries the slot therein. In such preferred embodiments, the manual engagement button preferably includes a substantially planar surface disposed opposite the substantially planar surface of the walls of the unified handle and shaving lubricant container, with substantially planar surfaces disposed in mutual contact.

The unified handle and shaving lubricant container preferably includes visual indicia disposed thereon opposite and adjacent the slot for indicating a predetermined amount of shaving lubricant which has been expelled therefrom when the membrane rupturing means has been disposed into a second position generally adjacent the visual indicia.

In these and other preferred embodiments of the disposable shaver of the present invention, at least the blade holding means of the shaving head and the unitary handle and shaving lubricant container are made from a plastic material. Such membrane rupturing means is also preferably made from a plastic material.

In an alternative preferred embodiment, the shaving head is substantially the same as the embodiment first described above. However, the unified handle and shaving lubricant container is of a modified variety. Therein, the handle is elongated and substantially rigid, with one end thereof connected to the shaving head. An elongated shaving lubricant container is disposed longitudinally adjacent the handle member. The elongated shaving lubricant container is closed at the top and bottom, and shares a common front wall with the handle member. This common wall is adjoined by a pair of oppositely disposed, longitudinally corrugated and collapsible walls. Alternatively, in equivalent embodiments, the shaving lubricant container may be formed as an element separate from the rigid handle and disposed adjacent thereto without the necessity for a common wall. Each of the corrugated and collapsible walls is further joined by a common back wall to form a closed shaving lubricant container for the shaving lubricant. The shaving lubricant container has a closable aperture means thereon for permitting expelling of the shaving lubricant therefrom by pressure preferably manually exerted upon the corrugated walls to at least partially collapse the walls to dispense shaving lubricant from the aperture. In these embodiments of the disposable shaver of the present invention the closable aperture is located at the bottom of the shaving lubricant container.

In such embodiments, the closable aperture comprises an aperture closed by an aperture closure plug means. The aperture closure plug means is of such dimensions and size for snug disposition within the aperture. Such aperture closure plug means is attached to the lower surface of the unified handle and shaving lubricant container and preferably includes a groove disposal along the line of such attachment to provide hinge means therefor. Also, the aperture closure plug means may further preferably include on the bottom surface thereof, projecting means for opening the aperture closure plug means, such as by means of a finger nail.

Of course, it is understood that in the above and other equivalent embodiments the shaving lubricant may be contained within a separate flexible and collapsible container disposed within the unified handle and shaving lubricant container.

Referring now to the drawing and to FIGS. 1–6 in particular, the disposable shaver of the present invention generally 20 comprises in combination a shaving head generally 22, with a unified handle and shaving lubrican container generally 24.

Shaving head 22 includes at least one razor blade 26, and perhaps a second razor blade 28, which blades 26,28 are operatively disposed within a blade holding means 30. Blade holding means 30 has a shaving surface 32 thereon, as shown particularly in FIG. 1, for contact with the surface to be shaved, such as for example the beard of the user. Razor blades 26,28 are disposed and maintained into selected angle with respect to shaving surface 32 of blade holding means 30 for disposition in a proper configuration for satisfactory comfort and effectiveness in shaving, as is known to those skilled in the art.

Figure 3:
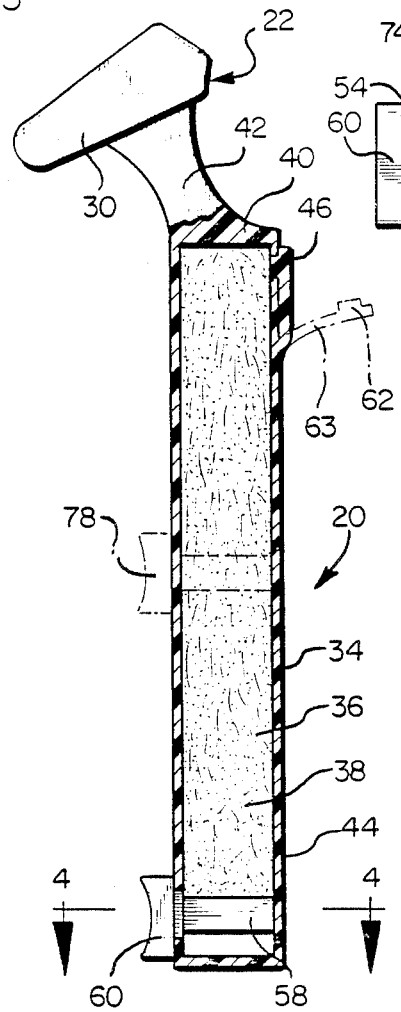
FIG. 3 is a longitudinal partial cross-sectional view of the embodiment of the disposable shaver as shown in FIG. 1, and showing the manual engagement button having been moved from its first position as shown in FIG. 1 to a second position (see phantom lines) representing the expelling of sufficient shaving lubricant for a designated number of shave(s), and further showing (also in phantom lines) the apperture plug in open position to permit shaving lubricant to be expelled therefrom.

In preferred embodiments of the disposable shaver 20 of the present invention, as shown in FIG. 3 in particular, the unified handle and shaving lubricant container 24 includes an elongated and substantially hollow shaving lubricant container 34 which has a bore 36 located therein for containing the shaving lubricant 38. The container 34 is connected at one end 40 thereof such as by means of a connecting and angled neck 42 to shaving head 22 to dispose shaving head 22 in proper shaving array when the unified handle and shaving lubricant container 24 is manually held.

Shaving lubricant container 24 is defined by walls 24 thereof and has a closable opening 46 disposed near one end 40 thereof as shown in FIG. 3. The shaving lubricant container walls 44 have a slot 48 therein which is closed by a relatively thin and rupturable membrane 50, as shown in FIG. 1. Slot 48 is disposed within and extends longitudinally along a front wall 52 of shaving lubricant container 34.

Figure 4:
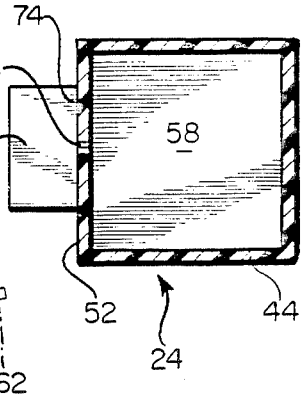
FIG. 4 is an enlarged transverse cross-sectional view taken along lines 4—4 of FIG. 3 and showing the manual engagement button, the membrane rupturing means attached thereto, shown disposed within the slot, and attached at the opposite side thereof to the lubricant pushing means, which is also shown in cross-section.

As shown in FIG. 4 in particular, unified handle and shaving lubricant container 24 further includes a membrane rupturing means 54 which is slidably disposed within slot 48 and initially disposed in a first position end 56 of shaving lubricant container 24. Membrane rupturing means 54 include and attached thereto a shaving lubricant pushing means 58, which is disposed within and substantially matches in cross-sectional shape bore 36 of unified handle and shaving lubricant container 24, as shown in FIG. 4. Membrane rupturing means 54 further includes a manual engagement button disposed at an opposite end thereof and attached thereto a manual engagement button 60. In operation, and as shown in FIG. 3, the user pushes upon and moves manual engagement button 60 longitudinally (in the direction of arrfow A of FIG. 1) with respect to unified handle and shaving lubricant container 24 to rupture membrane 50, to transport shaving lubricant pushing means 58 longitudinally within bore 36, and to force the shaving lubricant 38 to expel from end 40 of unified handle and shaving lubricant container 24 through closable opening 46 therein. Such manual engagement button 60 is then in the position shown in phantom lines in FIG. 3.

Figure 2:
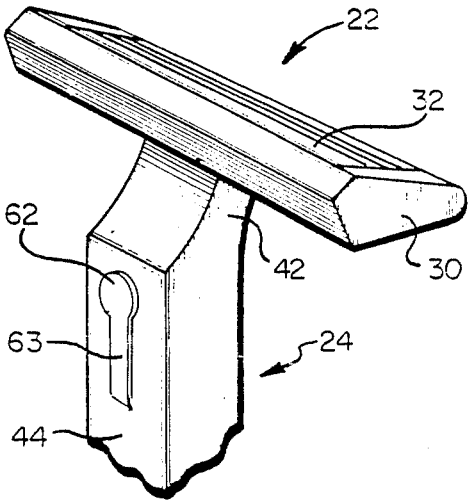
FIG. 2 is a slightly enlarged rear perspective view of the embodiment of the disposable shaver as shown in FIG. 1, and further showing, at the top rear of the unified handle and shaving lubricant container thereof, an aperture closed by a provided plug for preventing the expelling of any shaving lubricant therefrom.

As shown in FIGS. 2 and 3, in preferred embodiments of the disposable shaver of the present invention 20, unified handle and shaving lubricant container 24 further comprises a preferably unitarily formed and attached plug means 62 for closing closable opening 46 which is provided for preventing shaving lubricant to be expelled therefrom. Such plug means 62 may be attached to wall 44 by means of a hinge 63.

Figure 6:
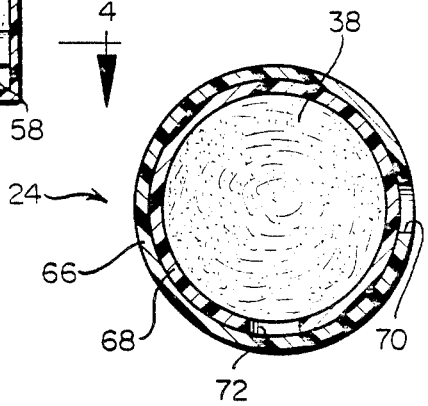
FIG. 6 is an enlarged cross-sectional view taken along lines 6—6 of FIG. 5 and further showing the details of the cylindrically shaped sleeve portions of the unified handle and shaving lubricant container, and the rotationable relationship thereof for expelling shaving lubricant therefrom.
Figure 5:
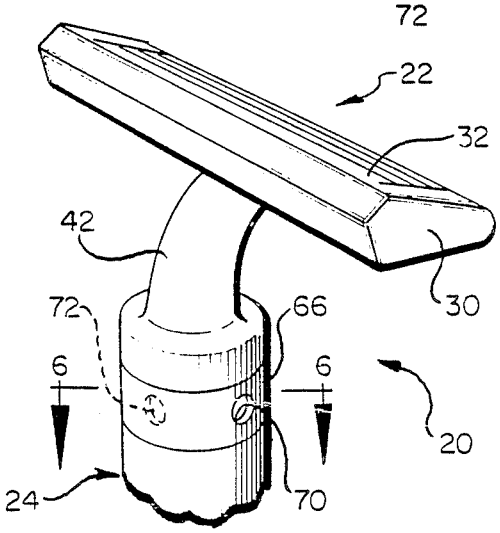
FIG. 5 is a slightly enlarged back perspective view of a preferred alternative embodiment of the disposable shaver of the present invention, and including a pair of cylindrically shaped sleeve portions each having an opening therein for expelling shaving lubricant therefrom, such that when such sleeves are rotated to render the apertures in alignment, the shaving lubricant may be expelled therefrom.
Figure 7:
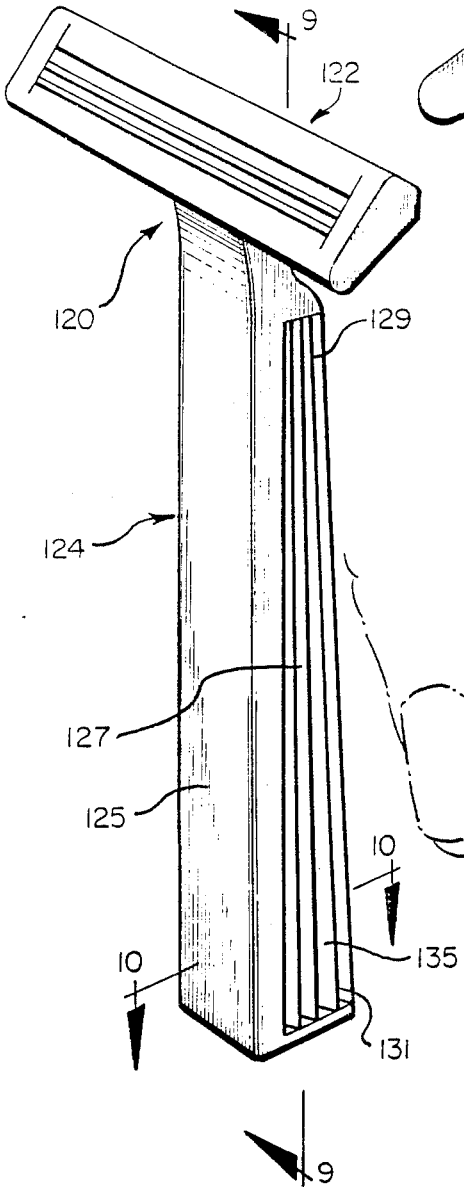
FIG. 7 is an enlarged front perspective view of the disposable shaver of the present invention showing a further alternative preferred embodiment of the unified handle and shaving lubricant container comprising a substantially rigid handle member connected to the shaving head, with an elongated shaving lubricant container disposed adjacent thereto, said elongated shaving lubricant container including a pair of oppositely disposed flexible corrugated and collapsible walls.
Figure 8:
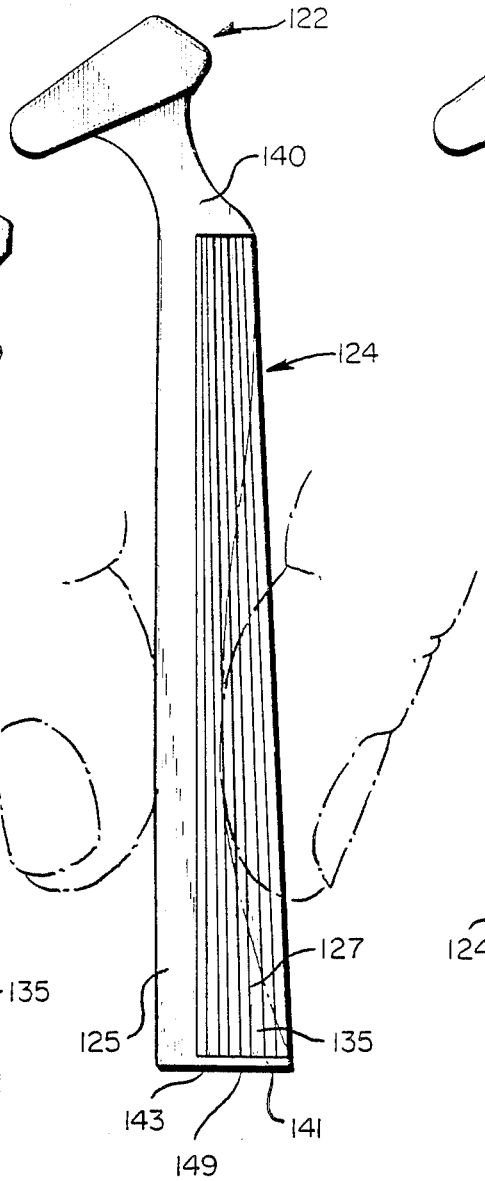
FIG. 8 is a side view of the disposable shaver embodiment of FIG. 7 showing (in phantom lines) the manual operation thereof.
Figure 9:
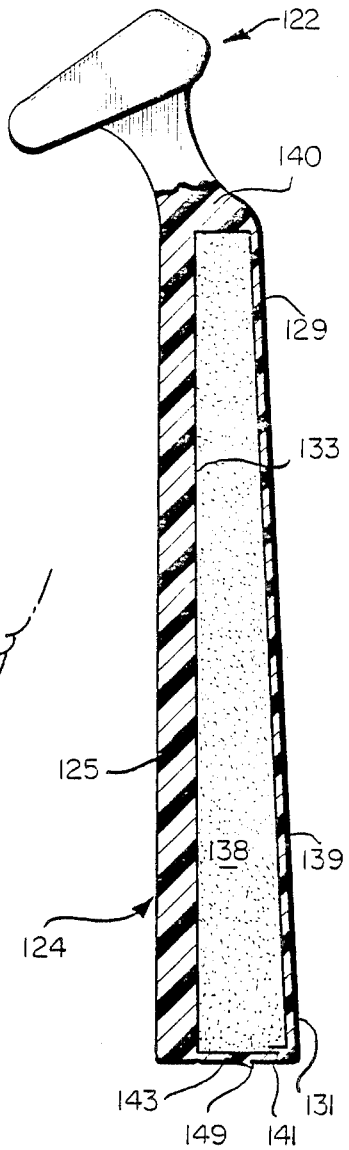
FIG. 9 is a longitudinal cross-sectional view taken along lines 9—9 of FIG. 7 and showing in cross-section the rigid handle, with the adjoining shaving lubricant container, and further showing the closable aperture located at the bottom thereof.

As shown in FIGS. 5 and 6, the disposable shaver of the present invention 20, in other preferred embodiments, may include a pair of cylindrically shaped sleeve portions 64,66 having respective openings 68,70 therein for expelling shaving lubricant 38 therefrom. The respective openings 68,70 are disposed in a common transverse plane, and sleeve portions 64,66 are disposed in rotational relationship, as depicted in FIGS. 5 and 6. In operation, upon rotation of one of the sleeve portions 64 with respect to the other 66, openings 68,70 are aligned to permit expelling of shaving lubricant 38 therefrom. In this embodiment of the disposable shaver 20 of the present invention, openings 68,70 in such sleeve portions 64,66 are disposed near end 40 of unified handle and shaving lubricant container 24, such end being opposite from end 56 thereof having membrane rupturing means 54 when disposed in the first position as shown in FIGS. 1 and 3.

In the preferred embodiments as shown in at least FIGS. 1–4 of disposable shaver 20 of the present invention, walls 44 of unified handle and shaving lubricant container 24 may preferably have at least one exterior surface which is substantially planar, such as front wall 52. Such substantially planar surface of front wall 52 preferably carries slot 48 therein. In such preferred embodiments, manual engagement button 60 preferably includes a substantially planar rear surface 74 disposed opposite the substantially planar surface of front wall 52 of unified handle and shaving lubricant container 24, with such substantially planar surfaces 52,74 disposed in mutual contact, as shown in FIGS. 1, 3 and 4.

Unified handle and shaving lubricant container 24 preferably includes visual indicia 76 disposed thereon opposite and adjacent slot 48 for indicating a predetermined amount of shaving lubricant 38 which has been expelled therefrom when membrane rupturing means 54 has been disposed into a second position 78 generally adjacent the visual indicia, as shown in FIGS. 1 and 3.

In these and other preferred embodiments of the disposable shaver of the present invention, at least the blade holding means 30 of shaving head 22 and unitary handle and shaving lubricant container 24 are made from a plastic material. Such membrane rupturing means 54, manual engagement button 60, and shaving lubricant pushing means 58, are also preferably made from a plastic material.

In an alternative preferred embodiment of the disposable shaver 120 of the present invention, the shaving head 122 is substantially the same as the embodiment first described above. However, the unified handle and shaving lubricant container generally 124 is of a modified variety. Therein, the handle member 125 is elongated and substantially rigid, with one end 140 thereof connected to shaving head 122. An elongated shaving lubricant container 127 is disposed longitudinally adjacent handle member 125. Elongated shaving lubricant container 127 is closed at the top 129 and bottom 132 thereof, and shares a common front wall 133 with handle member 125. Wall 133 is adjoined by a pair of oppositely disposed, longitudinally corrugated and collapsible walls 135,137. Alternatively, in equivalent embodiments, the shaving lubricant container may be formed as an element separate from the rigid handle and disposed adjacent thereto without the necessity for a common wall. Each of the corrugated and collapsible walls 135,137 is further joined by a common back wall 139 to form closed shaving lubricant container 127 for shaving lubricant 138. Shaving lubricant container 127 has a closable aperture means 141 thereon for permitting the expelling of shaving lubricant 138 therefrom by pressure preferably manually exerted upon corrugated walls 135,137 to at least partially collapse walls 135,137 to dispense shaving lubricant 138 from the aperture 141. In these embodiments of the disposable shaver 120 of the present invention, the closable aperture 141 is located at the bottom 143 of the shaving lubricant container 127.

Figure 10:
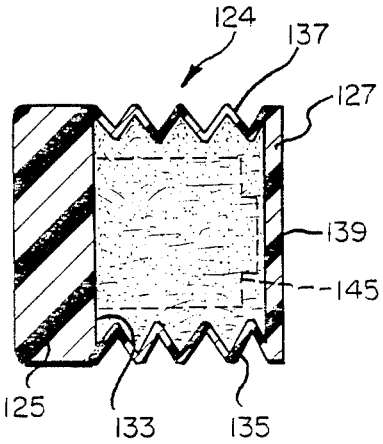
FIG. 10 is an enlarged transversed cross-sectional view taken along lines 10—10 of FIG. 7, showing the details of the collapsible corrugated walls, and further showing (in phantom lines) a top view of the aperture closing means disposed at the bottom end of the disposable shaver of the present invention.
Figure 11:
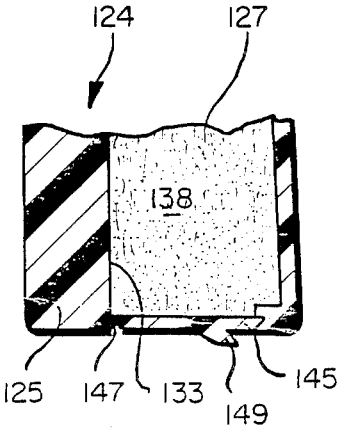
FIG. 11 is an enlarged partial longitudinal view of FIG. 9, showing in greater detail the aperture closure means, including the hinge means therefor, and the opening means disposed on the bottom surface thereof.
Figure 12:
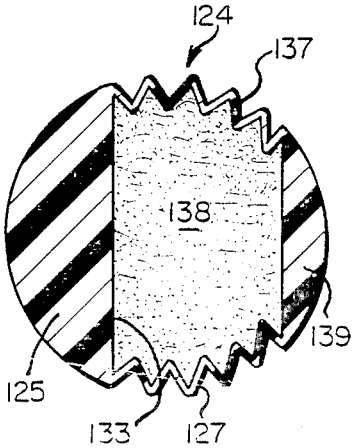
FIG. 12 is a transverse cross-sectional view of a modified embodiment similar to that of FIG. 10, but with round wall configuration.

In such embodiments, the closable aperture 141 comprises aperture 141 closed by an aperture closure plug means 145, as shown most clearly in FIGS. 10 and 11. The aperture closure plug means 145 formed in such shape is of such dimensions and size for snug disposition within aperture 141, as shown in FIG. 10. Such aperture closure plug means 145 is attached to the bottom 143 of unified handle and shaving lubricant container 124 and preferably includes a groove 147 disposed along the line of such attachment to provide hinge means therefor, as shown in FIG. 11. Also, the aperture closure plug means 145 may further preferably include on the bottom surface thereof, projecting means 149 for opening the aperture closure plug means 145, such as by means of a finger nail.

In the above description, certain specific details of some preferred and alternative embodiments of the present invention have been provided for a thorough understanding of the inventive concepts. It will be understood by those skilled in the art that many of these details may be varied without departing from the spirit and scope of the invention.

What is claimed is:

1. The disposable shaver comprising in combination a shaving head element and a unified handle and shaving lubricant container, said unified handle and shaving lubricant container comprising:

an elongated substantially rigid handle member connected at one end thereof to said shaving head;

an elongated shaving lubricant container disposed longitudinally adjacent said handle member, said elongated shaving lubricant container substantially coextensive in length with said handle member;

said elongated shaving lubricant container closed at the top and bottom, and sharing at least one common wall with said handle;

said common wall adjoined by a pair of oppositely disposed, longitudinally corrugated and collapsable walls, each of which is further joined by a further common wall to form a closed shaving lubricant container for the shaving lubricant; and said shaving lubricant container having closeable aperture means therein for permitting expelling shaving lubricant therefrom by pressure exerted upon said corrugated walls to at least partially collapse said walls to dispose shaving lubricant from said aperture.

2. The disposable shaver of claim 1 wherein said closable aperature comprises an aperture closed by an aperture closure plug means.

3. The disposable shaver of claim 2 wherein said aperture closure plug means is of such dimensions and size for snug disposition within said aperture.

4. The disposable shaver of claim 3 wherein said aperture closure plug means is attached to the lower surface of said unified handle and shaving lubricant container and includes a groove disposed along the line of attachment to provide hinge means therefor.

5. The disposable shaver of claim 2 wherein said aperture closure plug means further includes on the bottom surface thereof projecting means for opening said aperture closure plug means.

* * * * *